US009995067B2

(12) United States Patent
Promutico

(10) Patent No.: US 9,995,067 B2
(45) Date of Patent: Jun. 12, 2018

(54) DOOR-LOCK DEVICE

(71) Applicant: BITRON S.p.A., Turin (IT)

(72) Inventor: Fabrizio Promutico, Turin (IT)

(73) Assignee: Bitron, S.p.A., Turin (IT)

( * ) Notice: Subject to any disclaimer, the term of this patent is extended or adjusted under 35 U.S.C. 154(b) by 451 days.

(21) Appl. No.: 14/435,949

(22) PCT Filed: Oct. 8, 2013

(86) PCT No.: PCT/IT2013/000272
§ 371 (c)(1),
(2) Date: Apr. 15, 2015

(87) PCT Pub. No.: WO2014/061044
PCT Pub. Date: Apr. 24, 2014

(65) Prior Publication Data

US 2015/0267446 A1 Sep. 24, 2015

(30) Foreign Application Priority Data

Oct. 16, 2012 (IT) ..... RM2012A0492

(51) Int. Cl.
*E05C 5/00* (2006.01)
*E05C 19/12* (2006.01)
(Continued)

(52) U.S. Cl.
CPC ..... *E05C 19/12* (2013.01); *A47L 15/4259* (2013.01); *D06F 37/42* (2013.01);
(Continued)

(58) Field of Classification Search
CPC ..... Y10T 292/0911; Y10T 292/0913; Y10T 292/0914; Y10T 292/0918;
(Continued)

(56) References Cited

U.S. PATENT DOCUMENTS 3,201,160 A 8/1965 Lewin
3,803,575 A * 4/1974 Gotanda ..... E05B 45/083 200/61.64
(Continued)

FOREIGN PATENT DOCUMENTS

DE 4424201 A1 * 1/1996 ..... A47L 15/4259
EP 1304436 A2 * 4/2003 ..... D06F 39/14
(Continued)

OTHER PUBLICATIONS

International Search Report from corresponding International Patent Application No. PCT/IT2013/000272 dated May 21, 2014; 4 pages.

*Primary Examiner* — Alyson M Merlino
(74) *Attorney, Agent, or Firm* — Maier & Maier, PLLC

(57) ABSTRACT

A door-lock device having a casing, a slider, arranged within said casing, a locking hook with a body and a locking portion, said body having a cam shape which abuts said slider, said locking hook capable to assume a rest position, in which said locking portion is disengaged from said recess, and an operative position, in which said locking portion is inserted, and engaged with, said recess, and pushing capabilities, for keeping said slider in contact with said cam surface, so when said door is closed, said locking hook passes from said rest position to said operative position, said cam shape compressing said pushing capabilities, so that said pushing capabilities accumulate energy and said slider exerts a resistance to the closing of said door, and, then, allowing said pushing capabilities to release said energy, so that said slider exerts a return action on said locking hook and on said door.

8 Claims, 5 Drawing Sheets

(51) Int. Cl.

| | |
|---|---|
| ***A47L 15/42*** | (2006.01) |
| ***D06F 37/42*** | (2006.01) |
| ***E05C 19/02*** | (2006.01) |
| ***E05B 47/00*** | (2006.01) |
| *E05C 19/14* | (2006.01) |

(52) U.S. Cl.
CPC ..... *E05B 47/0038* (2013.01); *E05C 19/02* (2013.01); *A47L 2401/26* (2013.01); *A47L 2501/28* (2013.01); *E05B 47/0046* (2013.01); *E05B 2047/0068* (2013.01); *E05C 19/14* (2013.01); *E05C 2005/005* (2013.01); *Y10T 292/0911* (2015.04); *Y10T 292/0928* (2015.04)

(58) Field of Classification Search
CPC ..... Y10T 292/0915; Y10T 292/0926; Y10T 292/0928; Y10T 292/093; Y10T 292/0934; Y10T 292/0945; Y10T 292/0947; Y10T 292/0948; Y10T 292/0951; Y10T 292/0952; Y10T 292/0959; Y10T 292/0886; Y10T 292/0887; Y10T 292/0891; Y10T 292/0889; Y10S 292/04; Y10S 292/69; Y10S 292/71; E05B 2047/0068; E05C 19/02; E05C 19/12; E05C 19/14; E05C 19/06; E05C 19/063; E05C 2005/005; A47L 15/4259; A47L 2401/26; A47L 2501/28; D06F 37/42
See application file for complete search history.

(56) References Cited

U.S. PATENT DOCUMENTS

| | | | | |
|---|---|---|---|---|
| 4,687,237 | A | 8/1987 | Bisbing | |
| 7,377,560 | B2 * | 5/2008 | Wiemer | E05C 19/16 292/251.5 |
| 8,686,869 | B2 * | 4/2014 | Sharma | G01B 7/31 292/251.5 |
| 2005/0127683 | A1 | 6/2005 | Nam | |
| 2006/0012187 | A1 * | 1/2006 | Adachi | E05B 17/0041 292/304 |
| 2012/0138108 | A1 * | 6/2012 | Astiz Montoya | A47L 15/0049 134/113 |
| 2013/0234578 | A1 * | 9/2013 | Ala | A47L 15/4259 312/326 |

FOREIGN PATENT DOCUMENTS

| | | | | |
|---|---|---|---|---|
| EP | 2471433 | A1 * | 7/2012 | A47L 15/4259 |
| FR | 1 004 715 | A | 4/1952 | |
| GB | 2306052 | A | 4/1997 | |
| WO | 99/18314 | A1 | 4/1999 | |
| WO | 2010/073231 | A1 | 7/2010 | |

* cited by examiner

DOOR-LOCK DEVICE

CROSS REFERENCE TO RELATED APPLICATIONS

This application is based upon and claims the benefit of priority from the prior Italian Patent Application No. RM2012A000492, filed on Oct. 16, 2012, and International Patent Application No. PCT/IT2013/000272, filed on Oct. 8, 2013, the entire contents of which are incorporated herein by reference.

BACKGROUND

As it is well known there are currently several types of door-lock devices for household appliances, such as dishwashers and the like. Said door-lock devices comprise, generally, a member or locking hook capable of engaging with the door of the household appliance.

The locking hook is generally moveable, so as to assume a rest position, in which it is disengaged from said door, and an operating position, in which it is engaged with said door, so as to keep it closed.

An example of a door-lock device according to the prior art is described in U.S. Pat. No. 7,690,700.

A problem of the door-lock devices according to the prior art is the complexity with which they are often made.

In the field it is also felt the need for which, in case of tampering, the door-lock device can automatically restore its correct operation, without requiring a technician to disassemble the same.

SUMMARY

In light of the above, it is, therefore, object of the present invention to provide a door-lock device, which presents a reduced construction complexity, enabling a restore effect in the closing phase and which is capable to automatically restore its operation in case of tampering.

It is therefore specific object of the present invention a door-lock device for a closing door of an household appliance said door being provided with a recess, said door-lock device comprising a casing, a slider, arranged within said casing, a locking hook comprising a body and a locking portion, said body having a cam shape which abuts on said slider, said locking hook being capable to assume a rest position, in which said locking portion is disengaged from said recess, and an operative position, in which said locking portion is inserted into, and engaged with, said recess, and pushing means, for normally keeping said slider in contact with said cam surface, such that, when said door is closed, said locking hook passes from said rest position to said operative position, said cam shape of said locking hook initially compressing said pushing means, so that said pushing means accumulate a potential energy and said slider exerts a resistance to the closing of said door, and, then, allowing said pushing means to release said accumulated potential energy, so that said slider exerts a return action on said locking hook and on said door; and vice versa when said door is opened.

Always according to the invention, the free end of said locking portion could have a curved surface adapted to interact with said recess when said door is closed, so as to bring said locking hook from said rest position to said operative position.

Still according to the invention, said pushing means could comprise at least one spring, preferably two springs.

Further according to the invention, said casing could comprises a base and a cover, said base having laterally a first pair of horizontal rear slots and a second pair of vertical front slots, said slider could comprise two arms joined together by a transversal connecting element, each of said arms of said slider comprising a pair of rear pins, slidingly and rotatably coupled with said rear slots of said base and frontally having a pair of slots, and said locking hook could comprise a pin on which said body of said locking hook is pivoted, said pin being inserted in said slots of said slider and in said front slots of said base.

Advantageously according to the invention, said connecting element could have a first surface and a second surface, said cam could abut on the second surface of said connecting element and said pushing means could be interposed between said base and said first surface of said connecting element of said slider.

Always according to the invention, said device could comprise a locking element, fixable to said door of said household appliance, provided with said recess with which said locking portion of said locking hook is engageable.

Still according to the invention, said locking portion of said locking hook could be provided with a seat, in which a permanent magnet is arranged, and said locking element could have a housing in which a electric circuit board is inserted, electrically connectable to the control logic of said household appliance, said electric circuit board comprises magnetic field sensors, as magnetoresistors and/or the like, arranged close to said recess, so as to detect the magnetic field of said permanent magnet when said door is closed and said locking hook is engaged with the recess.

In is further object of the present invention a locking element fixable to the door of a household appliance, provided with said recess, with which a locking hook of a door-lock device is capable of engaging.

Always according to the invention, said locking element could be provided with a housing in which a electric circuit board is inserted, electrically connectable to the control logic to said household appliance, said electric circuit board could comprise magnetic field sensors such as magnetoresistors and/or the like, arranged close to said recess, so as to detect the magnetic field of a magnet installed on the locking hook of said household appliance when said door is closed and said locking hook is engaged with said recess.

BRIEF DESCRIPTION OF THE FIGURES

The present invention will be now described, for illustrative but not limitative purposes, according to its preferred embodiments, with particular reference to the figures of the enclosed drawings, wherein.

DETAILED DESCRIPTION

The present invention relates to a door-lock device.

More specifically, the invention concerns a door-lock device for household appliances, studied and realized in particular to allow the closing of the door of a household appliance equipped with a returning effect and capable to restore its operation in automatic mode in the event of tampering.

In the following, the description will be directed for use in a dishwasher, but it is clear that the same should not be considered limited to this specific use.

In the various figures, similar parts will be indicated by the same reference numbers.

Figure 1:
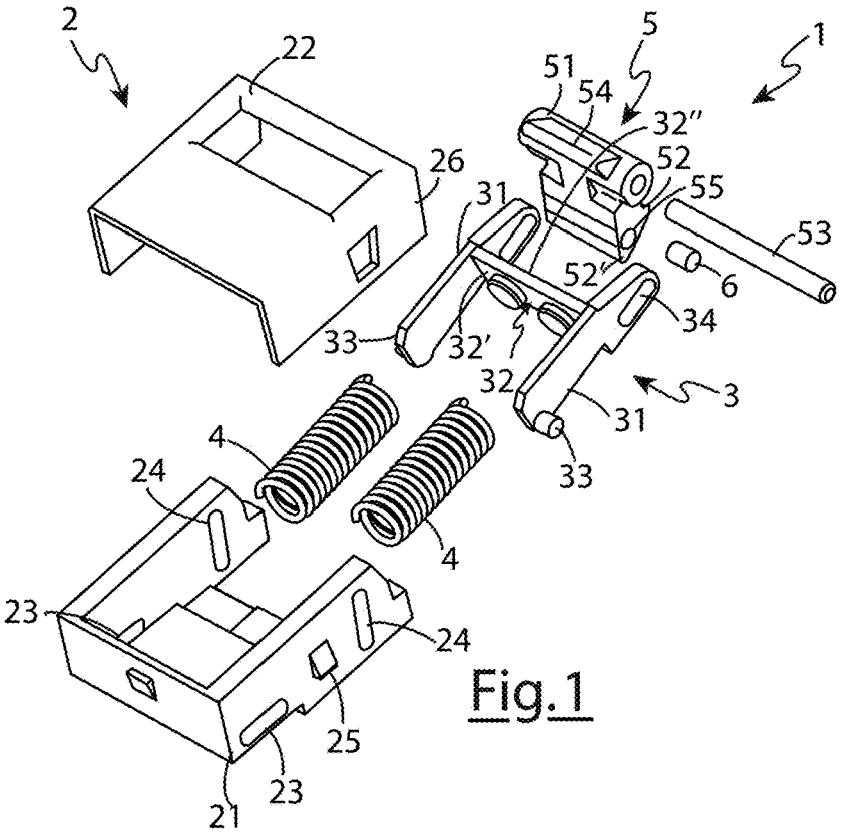
FIG. 1 shows an exploded view of a door-lock device according to the present invention.

Referring to FIG. 1, a door-lock device 1 according to the invention can be seen.

Said door-lock device 1 comprises a containment casing 2, in which a slider 3, a pair of springs 4 and a locking hook 5 are arranged.

The containment casing 2 comprises a base 21 and a lid 22. Said base 21 has a first pair of horizontal laterally rear slots 23 and a second pair of vertical front slots 24. Moreover, said base 21 comprises lateral reliefs 25, capable to fit in corresponding apertures 26, obtained on said cover 22.

The slider 3, which is substantially H-shaped, comprises two arms 31 joined together by a transversal plane connecting element 32. Said connecting element 32 has a first surface 32' and a second surface 32".

Each of said arms 31 of said slider 3 comprises a rear pair of pins 33, slidingly and rotatably coupled with said rear slots 23 of said base 21. Furthermore, each of said arms 31 has a pair of front slots 34.

The springs 4 are interposed compressed between said base 21 and said first surface 32' of said connection element 32 of said slider 31.

The locking hook 5 comprises a body 51, pivoted on a pin 53, inserted in said slots 34 of said slider 3 and said front slots 24 of said base 21, and a locking portion 52.

The end of said body 51 has a cam shape 54, which abuts the second surface 32" of said connection element 32, through the action of the springs 4.

The free end of said locking portion 52, has a curved surface 52', suitably shaped, the function of which will be better defined in the following, and a seat 55, in which a permanent magnet 6 is inserted.

The locking hook 5 is intended to engage with a corresponding recess (not shown in FIG. 1) arranged on the appliance door to be closed.

Figure 2:
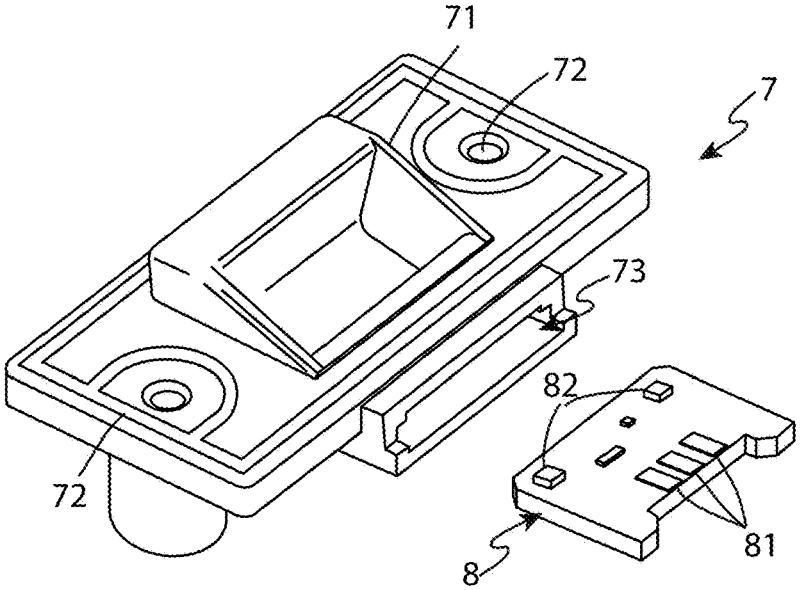
FIG. 2 shows a locking device capable to interact with the door-lock device according to FIG. 1.

In a particularly preferred embodiment of the invention, shown in FIG. 2, said recess 71 is made in a locking element 7, mounted on the door P of the dishwasher L.

Said locking element 7 also has holes 72, for inserting screws for coupling with said door P, and a housing 73, in which a circuit board 8 is inserted, connected by appropriate electrical connections (not shown in the figures) to the logic control of the dishwasher L. Said circuit board 8 is provided with electrical contacts 81 and magnetoresistors 82, the operation of which will be better explained in the following.

Figure 3:
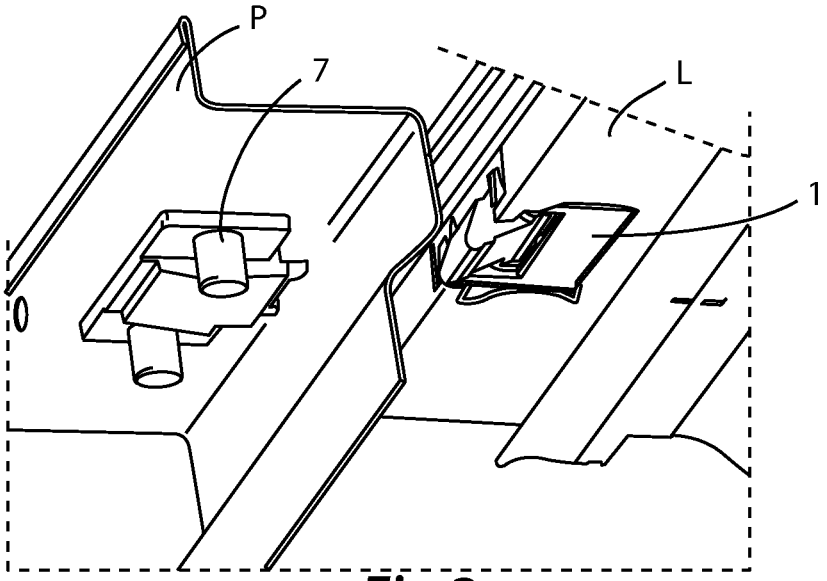
FIG. 3 shows a first perspective view of the door-lock device and the locking device installed on a dishwasher.
Figure 4:
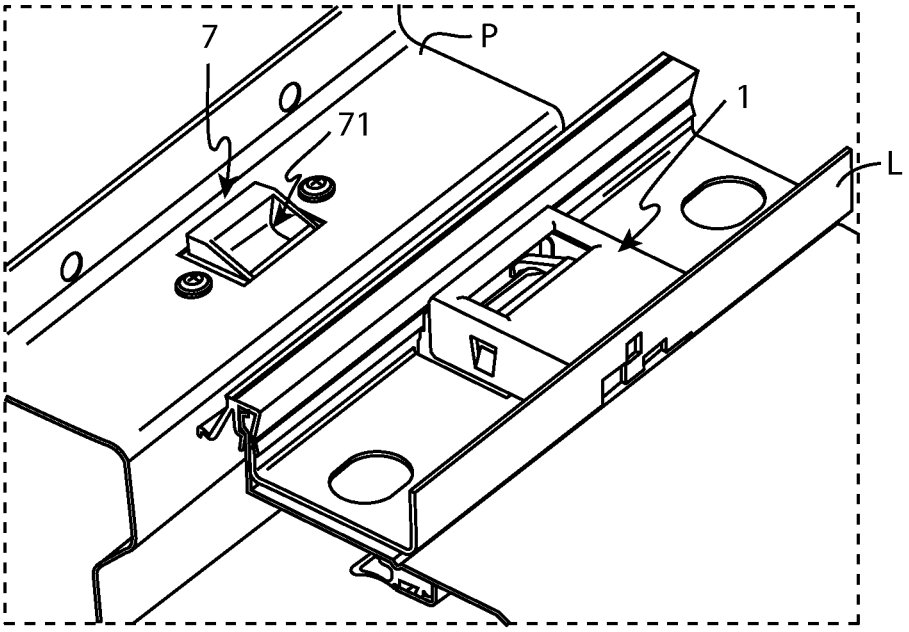
FIG. 4 shows a second perspective view of the door-lock device and the locking device installed on a dishwasher.

Referring to FIGS. 3 and 4 the door-lock device 1 installed on the frame of the dishwasher L and the locking element 7 installed on the door P of the same is observed, such that, when the door P is in closed position, said door-lock device 1 can interact with said locking element 7.

In the following the operation of the door-lock device 1 in combination with the locking device of FIG. 2, which, as said, is a preferred embodiment, will be described.

Figure 5:
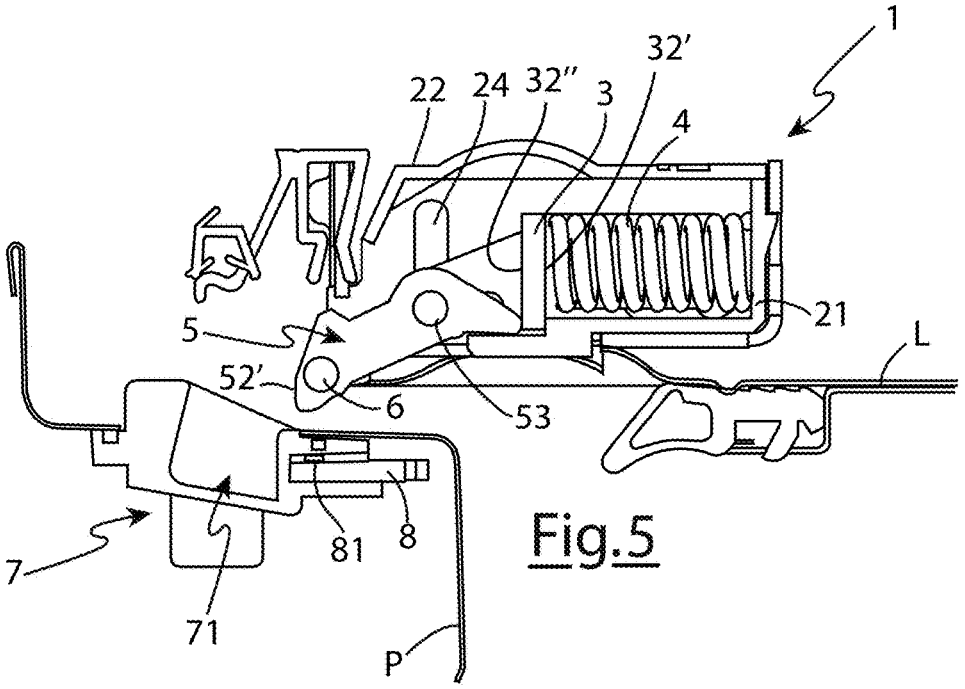
FIG. 5 shows the door-lock device according to FIG. 1 in open configuration.

Referring to FIG. 5, the configuration of the door-lock device 1 when the door P is open is observed. In particular, said locking hook 5 is in rest position, disengaged from said recess 71.

Figure 6:
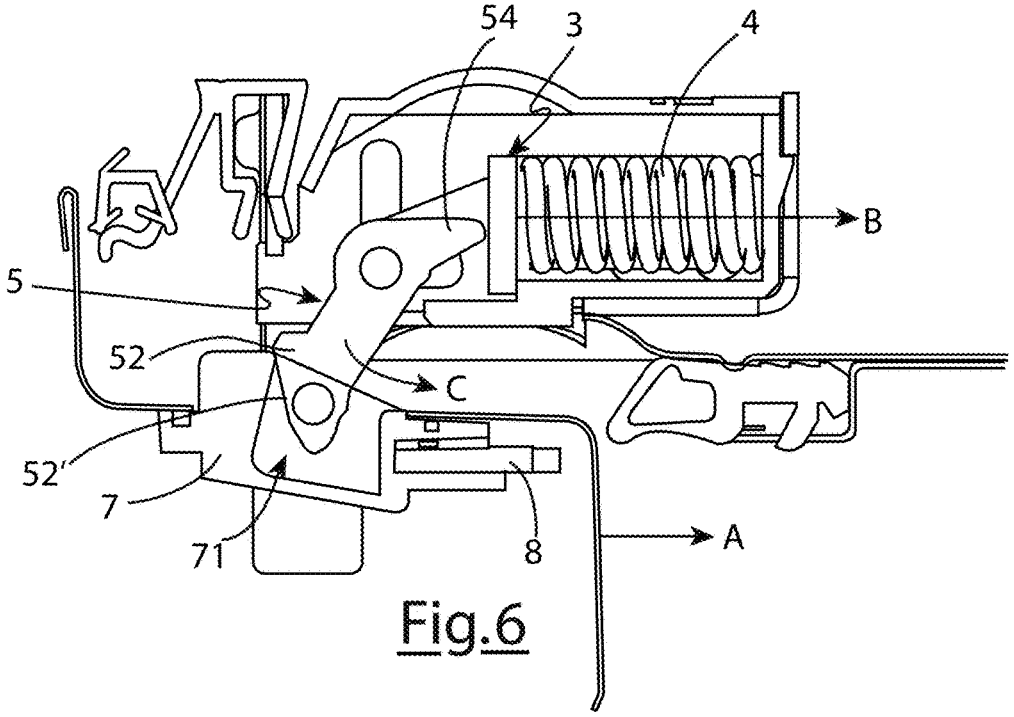
FIG. 6 shows the door-lock device according to FIG. 5 during the closing phase of a dishwasher door.

The curved surface 52' of said locking portion 52 of said locking hook 5, is shaped in such a way that, when the door P is closed (see FIG. 6) according to arrow A, interacting with the recess 71, it rotates said locking hook 5 around said pin 53, according to arrow C.

In this way, the cam shape 54 interferes with the second surface 32" of said connecting element 32. Springs 4 are thus initially further compressed, accumulating potential energy and causing the translational motion of the slider 3 in the direction of arrow B, since pins 33 slide along the rear slots 23 of the base 21.

Figure 7:
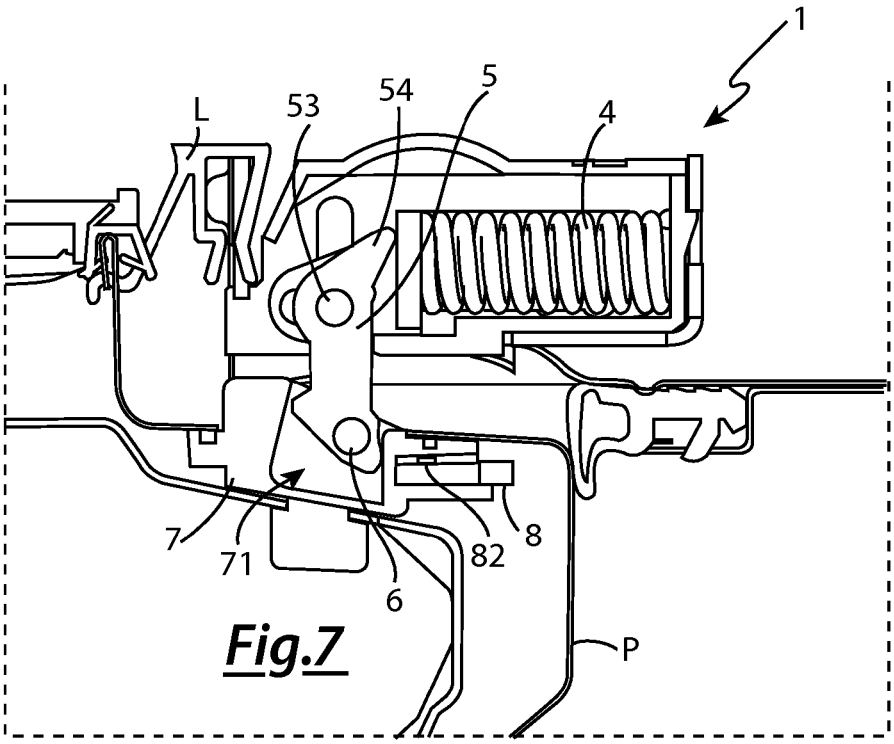
FIG. 7 shows the door-lock device according to FIG. 5 in open configuration.

Then, continuing the rotation of the locking hook 5 over an angle defined by the cam shape 54, said springs 4 release the potential energy accumulated and exert a push on the slider 3 in the direction opposite to the direction indicated by arrow B. In this way, the locking hook 5 tends to draw the door P and engages with the recess 71. In such a configuration, said locking hook 5 is in the operating position and the door P is thus also retained closed, as shown in FIG. 7.

In other words, due to the profile of the cam shape 54 and the force exerted by the springs 4 on the slider 3, it is obtained that, in a first moment, the locking hook 5 opposes a resistance to the closing of the door P, and in a second moment the locking hook 5 exerts an action that tends to return and close said door (P).

When the door P is closed, moreover, the magnetoresistors 82 are located close to said permanent magnet 6, which is, as said, within the locking portion 52 of said locking hook 5. Said magnetoresistors 82 then detect, by varying their impedance, that the door P is in closed position and the circuit board 8 communicates it to the control logic of the dishwasher L, so that the dishwasher, or the household appliance in general, can be activated for a washing cycle.

Figure 8:
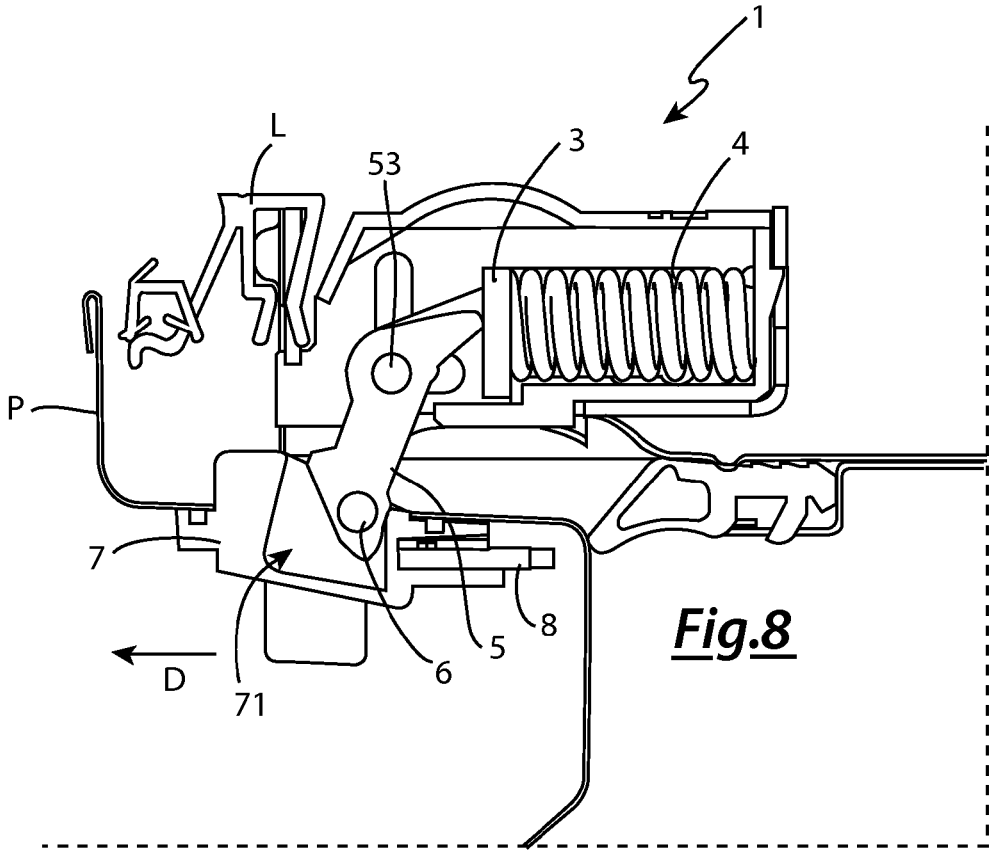
FIG. 8 shows the door-lock device according to FIG. 5 during the dishwasher door opening phase.
Figure 9:
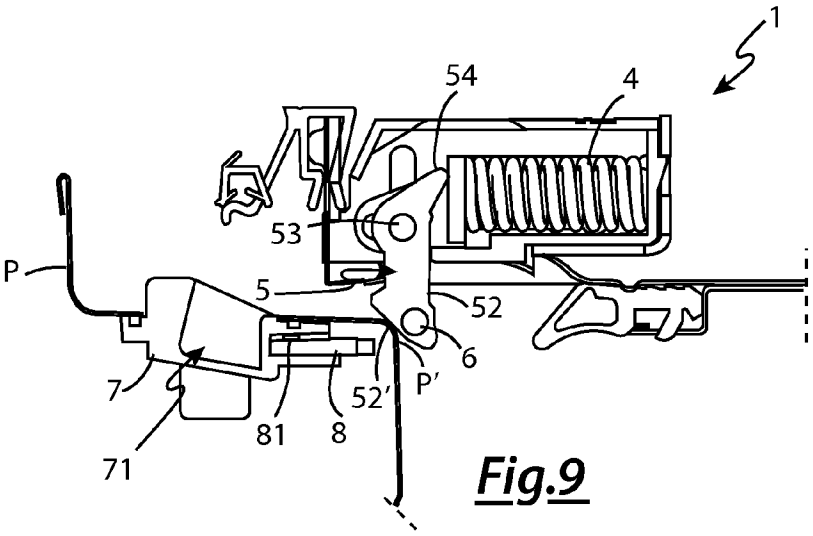
FIG. 9 shows the door lock device according to FIG. 5 in a different closing phases of the dishwasher door, in case of tampering of the locking hook.
Figure 10:
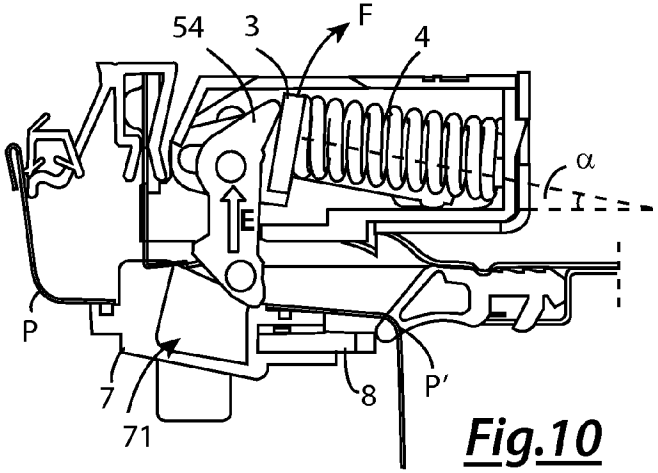
FIG. 10 shows the door lock device according to FIG. 5 in different a closing phases of the dishwasher door, in case of tampering of the locking hook.
Figure 11:
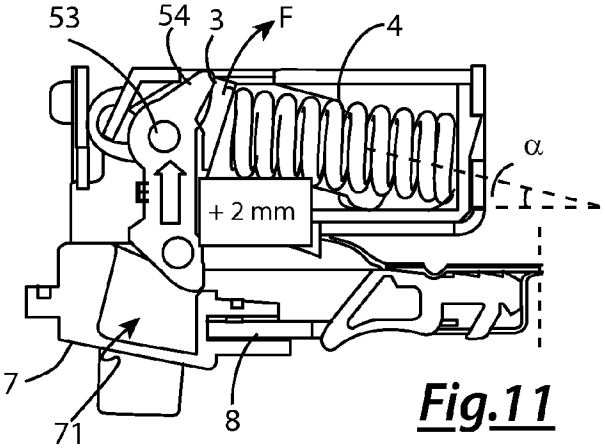
FIG. 11 shows the door lock device according to FIG. 5 in different a closing phases of the dishwasher door, in case of tampering of the locking hook.

When the door P is opened, and then moved according to arrow D, the operation of the door-lock device 1 (see FIG. 8) is fully equivalent to that in which the door P is closed.

In this case, in fact, said locking hook 5 passes from said operating position to said rest position. Said cam shape 54 of said locking hook 5 initially compresses said springs 4, so that they accumulate a potential energy and said slider 3 exerts a resistance to open of said door P, and then allows springs 4 to release said accumulated potential energy, so that said slider 3 exerts a push on said locking hook 5 and on said door P.

Referring now to FIGS. 9-12, the operating phases of the door lock device 1 are shown, in case the door P is opened and the locking hook 5 is in operating position, even if disengaged, then, from said recess 71. This configuration can take place following an even accidental tampering of the locking hook 5 with the door P opened. Closing, therefore, the door P, the edge P' of the same interacts with the curved surface 52' of said locking portion 52 of said locking hook 5 (see FIG. 9), causing a movement of the latter upwards about 2 millimeters, according to the arrow E (see FIGS. 10 and 11).

As it can be seen, the slider 3 and the locking hook 5 are rotatably constrained to each other around the pin 53. Furthermore, the latter is slidingly constrained with said front slots 24 of said base 21 and with said slots 34 of said slider 3. Therefore, the slider 3 is forced to rotate according to the arrow F by an angle $\alpha$, until said locking hook 5 is not in correspondence of said recess 71, as a result of the door P closing.

Figure 12:
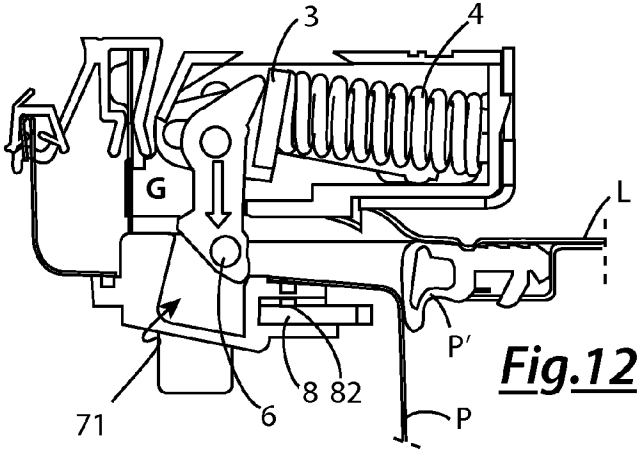
FIG. 12 shows the door lock device according to FIG. 5 in different a closing phases of the dishwasher door, in case of tampering of the locking hook.

Then, referring to FIG. 12, said locking hook 5, moves downwards, according to arrow G, and fits into and engages with said recess 71.

In this way, there is a self-restoring function of the operation of the door-lock device 1, as the latter returns to the configuration in which the locking hook 5 is in said operating position when the door P is closed.

An advantage of the present invention is that, by suitably modifying the profile of the cam shape of the locking hook, it is possible to change the closing force of the door.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A door-lock device for a closing door of a household appliance, said door being provided with a recess, said door-lock device comprising:

a casing;

a slider arranged within said casing;

a locking hook comprising a body and a locking portion, said body having a cam shape which abuts on said slider, said locking hook being capable to assume a rest position in which said locking portion is disengaged from said recess, and an operative position in which said locking portion is inserted into and engaged with said recess; and pushing means for normally keeping said slider in contact with said cam shape, wherein during closing of said door, said locking hook passes from said rest position to said operative position, said cam shape of said locking hook initially compressing said pushing means, so that said pushing means accumulate potential energy and said slider exerts a resistance to the closing of said door, and, then, allowing said pushing means to release said accumulated potential energy, so that said slider exerts a return action on said locking hook and on said door and vice versa during opening of said door, wherein said casing comprises a base and a cover, said base having a laterally-located first pair of horizontal rear slots and a laterally-located second pair of vertical front slots, wherein said slider comprises two arms joined together by a transversal connecting element, each of said arms of said slider comprising a rear pin, slidingly and rotatably coupled with said rear slots of said base and a pair of slots at a front thereof, and wherein said locking hook comprises a pin on which said body of said locking hook is pivoted, said pin positioned in said slots of said slider and in said front slots of said base.

2. The door-lock device according to claim 1, wherein a free end of said locking portion has a curved surface adapted to interact with said recess during the closing of said door so as to bring said locking hook from said rest position to said operative position.

3. The door-lock device of claim 1, wherein said pushing means comprises at least one spring.

4. The door-lock device according to claim 1, wherein said connecting element has a first surface and a second surface, wherein said cam shape abuts on the second surface of said connecting element, and wherein said pushing means are interposed between said base and said first surface of said connecting element of said slider.

5. The door-lock device according to claim 1, further comprising:

a locking element, fixable to said door of said household appliance, said locking element providing said recess with which said locking portion of said locking hook is engageable.

6. The door-lock device according to claim 5, wherein said locking portion of said locking hook is provided with a seat in which a permanent magnet is arranged, and wherein said locking element has a housing in which an electric circuit board is inserted, said electric circuit board being electrically connectable to a control logic of said household appliance, and said electric circuit board comprising magnetic field sensors arranged close to said recess so as to detect a magnetic field of said permanent magnet when said door is closed and said locking portion is inserted into and engaged with the recess.

7. A door locking device, comprising:

a locking element fixable to a door of a household appliance, said locking element being provided with a recess; and a locking hook of a door-lock device that engages the recess, wherein said door-lock device comprises:

a casing;

a slider arranged within said casing;

the locking hook comprising a body and a locking portion, said body having a cam shape which abuts on said slider, said locking hook being capable to assume a rest position in which said locking portion is disengaged from said recess, and an operative position in which said locking portion is inserted into and engaged with said recess; and pushing means for normally keeping said slider in contact with said cam shape, wherein during closing of said door, said locking hook passes from said rest position to said operative position, said cam shape of said locking hook initially compressing said pushing means, so that said pushing means accumulate potential energy and said slider exerts a resistance to the closing of said door, and, then, allowing said pushing means to release said accumulated potential energy, so that said slider exerts a return action on said locking hook and on said door and vice versa during opening of said door, wherein said casing comprises a base and a cover, said base having a laterally-located first pair of horizontal rear slots and a laterally-located second pair of vertical front slots, wherein said slider comprises two arms joined together by a transversal connecting element, each of said arms of said slider comprising a rear pin, slidingly and rotatably coupled with said rear slots of said base and a pair of slots at a front thereof, and wherein said locking hook comprises a pin on which said body of said locking hook is pivoted, said pin positioned in said slots of said slider and in said front slots of said base.

8. The door locking device according to claim 7, said locking element further comprising a housing in which an electric circuit board is inserted, the electric circuit board being electrically connectable to a control logic of said household appliance, and said electric circuit board comprising magnetic field sensors arranged close to said recess so as to detect a magnetic field of a magnet installed on the locking hook of said household appliance when said door is closed and said locking hook is engaged with said recess.

* * * * *